US008857568B2

(12) United States Patent
Foster, Sr. et al.

(10) Patent No.: US 8,857,568 B2
(45) **Date of Patent: *Oct. 14, 2014**

(54) ROLLING TOE ASSIST

(76) Inventors: Odes Foster, Sr., Houston, TX (US); Odes Foster, Jr., Houston, TX (US)

( * ) Notice: Subject to any disclaimer, the term of this patent is extended or adjusted under 35 U.S.C. 154(b) by 586 days.

This patent is subject to a terminal disclaimer.

(21) Appl. No.: 12/954,615

(22) Filed: Nov. 25, 2010

(65) Prior Publication Data

US 2011/0315478 A1 Dec. 29, 2011

Related U.S. Application Data

(63) Continuation-in-part of application No. 12/911,730, filed on Oct. 26, 2010.

(60) Provisional application No. 61/398,464, filed on Jun. 25, 2010.

(51) Int. Cl.

| | |
|---|---|
| ***E04G 1/36*** | (2006.01) |
| ***E06C 7/48*** | (2006.01) |
| ***E06C 1/34*** | (2006.01) |
| ***E06C 1/10*** | (2006.01) |

(52) U.S. Cl.

CPC ..... *E06C 1/345* (2013.01); *E06C 7/488* (2013.01); *E06C 1/10* (2013.01)

USPC ..... 182/45

(58) Field of Classification Search

CPC ..... E04G 3/26; E06C 1/345; E06C 7/488

USPC ..... 182/45, 206, 108, 129; 248/237; 52/652.1

See application file for complete search history.

(56) References Cited

U.S. PATENT DOCUMENTS

| | | | | | |
|---|---|---|---|---|---|
| 232,556 | A | * | 9/1880 | Silvius | 182/45 |
| 3,447,631 | A | * | 6/1969 | Smith | 182/108 |

(Continued)

FOREIGN PATENT DOCUMENTS

| | | | | | |
|---|---|---|---|---|---|
| DE | 3305342 | A1 | * | 8/1984 | E04G 3/12 |
| DE | 3445682 | A1 | * | 6/1986 | E04G 3/12 |
| FR | 1480212 | A | * | 5/1967 | E06C 7/488 |
| GB | 2155528 | A | * | 9/1985 | E06C 7/48 |
| JP | 09112023 | A | * | 4/1997 | E04G 1/36 |

OTHER PUBLICATIONS

English translation of abstract of DE 3305342 to Baumann, 2 pages.*

(Continued)

*Primary Examiner* — Charles A. Fox
*Assistant Examiner* — Kristine Florio
(74) *Attorney, Agent, or Firm* — Conley Rose, P.C.; Rodney B. Carroll; Keith C. Rawlins

(57) ABSTRACT

A ladder, system, and methods are disclosed. The ladder is used on a steep-pitched roof and has a first section with rungs, a second section connected to the first section, a third section connected to the second section, and a paw pivotally connected to the third section. The third section has a length less than or equal to a length of the second section, and the third section also has a length less than a distance between a first rung of the rungs and an end of the first section. The ladder can be used in a system that utilizes the ladder and a roof-anchor apparatus, where the roof-anchor apparatus has two portions and two shoes interconnected to the portions. A method includes positioning the ladder and then positioning the roof-anchor apparatus, on and over a steep-pitched roof, respectively.

15 Claims, 4 Drawing Sheets

(56) References Cited

U.S. PATENT DOCUMENTS

| | | | | |
|---|---|---|---|---|
| 4,179,011 | A * | 12/1979 | Morawski | 182/45 |
| 4,531,613 | A * | 7/1985 | Keigher | 182/206 |
| 4,844,207 | A * | 7/1989 | Andrews et al. | 182/151 |
| 6,092,624 | A * | 7/2000 | Slater | 182/45 |
| 6,167,987 | B1 | 1/2001 | Jensen | |
| 6,394,229 | B1 * | 5/2002 | Hastreiter | 182/107 |
| 7,028,809 | B2 * | 4/2006 | Dudschus | 182/214 |
| 2007/0227819 | A1 * | 10/2007 | Layfield | 182/206 |
| 2011/0314769 | A1 | 12/2011 | Foster, Sr. et al. | |

OTHER PUBLICATIONS

English translation of abstract of JP 09112023 to Matsuoka, 2 pages.*

Filing receipt and application for provisional patent application entitled "Steep Roof Assist," by Odes Foster, Jr., filed Jun. 25, 2010 as U.S. Appl. No. 61/398,464.

Office Action dated Sep. 28, 2012, 9 pages, U.S. Appl. No. 12/911,730, filed Oct. 26, 2010.

* cited by examiner

ROLLING TOE ASSIST

REFERENCE TO RELATED APPLICATIONS

This application claims the benefit of, and incorporates by reference, U.S. Provisional Application No. 61/398,464, filed on Jun. 25, 2010. This application is a continuation-in-part of, and incorporates by reference, U.S. patent application Ser. No. 12/911,730, filed on Oct. 26, 2010.

TECHNICAL FIELD

The disclosure relates to ladders. More particularly, the disclosure relates to ladders used on steep-pitched roofs. Additionally, the disclosure relates to horizontally and vertically traversing steep-pitched roofs. Additionally still, the disclosure relates to equipment for anchoring persons while on a steep-pitched roof.

BACKGROUND

Roofs can be constructed with surfaces thereof having a steep pitch, and various roof workers must traverse the steep-pitched roofs. Roof workers include but are not limited to: satellite-dish installers, home-owners, chimney workers, telecommunications personnel, and electricians.

By way of example, to install a satellite dish, a roof worker typically climbs a traditional ladder in order to access the roof. The roof worker then traverses vertically on the roof to determine a height for the dish, traverses horizontally on the roof to determine a lateral position for the satellite dish, and places the satellite dish at the determined height and lateral position on the roof. The height and lateral position of the satellite dish are determined as the optimal place on the roof for the satellite dish to receive satellite signals. Thus, roof workers traverse both horizontally and vertically on steep-pitched roofs in order to install satellite equipment.

When a roof worker horizontally and vertically traverses a steep-pitched roof, a variety of problems can arise. First, footing is unstable. Continuing with the example above, unstable footing leads to less efficient satellite-dish installations because roof workers dedicate time and energy to maintaining a firm footing in addition to installing equipment. The loss of time and energy is not recoverable and is a built-in cost of doing business for companies that install satellite dishes. Second, persons and companies must carry insurance in the event someone has trouble balancing both his/her own weight and/or the weight of any equipment, resulting in a fall and/or injury of the roof worker, the equipment, and/or other people. Insurance adds to the cost of owning a steep-pitched roof or doing business on steep-pitched roofs for persons and companies.

In order to vertically traverse a steep-pitched roof after accessing the steep pitch with a traditional ladder, a roof worker can use what is known in the prior art as a "chicken ladder."

SUMMARY

A ladder is used on a steep-pitched roof, and an embodiment of the ladder comprises a first section having a plurality of rungs, a second section connected to the first section, a third section connected to the second section, and a paw pivotally connected to the third section. The third section has a length less than or equal to a length of the second section, and the third section also has a length less than a distance between a first rung of the plurality of rungs and an end of the first section.

The first section has an inner surface, the second section has an inner surface, and the third section has an inner surface. Each of the first section and the second section and the third section comprises a first rail and a second rail extending parallel to the first rail. Each of the plurality of rungs has ends attached to an outer surface of the first section.

A castor can be positioned on the first section, and the distance between the first rung of the plurality of rungs and the end of the first section is less than or equal to a distance between the castor and the end of the first section. An anchor member can be positioned on the first section. A pad extends along the inner surface of the first, second, and third sections. A bumper can be attached to an outer surface of the first section and to an outer surface of the second section. The bumper can be attached to the end of the first section and to an end of the second section.

The paw of the ladder comprises an ankle member pivotally attached to the third section, a foot member attached to the ankle member, and a sole member attached to an underside of the foot member. The sole member has a width greater than a width of the foot member.

The ladder can be used in a system with a roof-anchor apparatus on a steep-pitched roof, where the steep-pitched roof has a ridge and a first surface extending from the ridge and a second surface extending from the ridge and where an embodiment of the roof-anchor apparatus is used over the ridge of the steep-pitched roof and has a first portion angularly connected to a second portion, a first shoe interconnected to the first portion of the roof-anchor apparatus and positioned on the first surface of the steep-pitched roof, and a second shoe interconnected to the second portion of the roof-anchor apparatus and positioned on the second surface of the steep-pitched roof. The first portion of the roof-anchor apparatus is positioned at an angle relative to the second portion of the roof-anchor apparatus, and the first shoe and the second shoe are at least partially formed of a rubber material.

A method uses the ladder and the roof-anchor apparatus to traverse a steep-pitched roof, and an embodiment of the method comprises rolling the castor on the outer surface of the first section of the ladder up the first surface of the steep-pitched roof so that the outer surface of the ladder faces the first surface of the steep-pitched roof during the step of rolling, positioning the castor of the ladder adjacent the ridge and on the first surface so that a plane of the paw of the ladder clears the ridge and so that the paw of the ladder is positioned above the first surface of the roof during the steps of rolling and positioning, flipping the ladder so that the paw of the ladder is positioned above the second surface of the roof and so that the inner surface of the first section of the ladder faces the first surface of the roof after the step of flipping, and sliding the ladder downwardly along the first surface of the roof until the paw of the ladder engages the second surface of the roof. The pad of the ladder is positioned between the first surface of the roof and the inner surface of the ladder. The sole member of the paw contacts the second surface of the roof. A person using the ladder and roof-anchor apparatus can tie-off to an anchor member connected to the first section of the ladder. A person using the ladder and roof-anchor apparatus can then tie-off to an anchor member connected to the first portion or second portion of the roof-anchor apparatus. In the method, the first shoe of the roof-anchor apparatus is placed on the first surface of the roof, and the second shoe of the roof-anchor apparatus is placed on the second surface of the roof.

DETAILED DESCRIPTION

Figure 1:
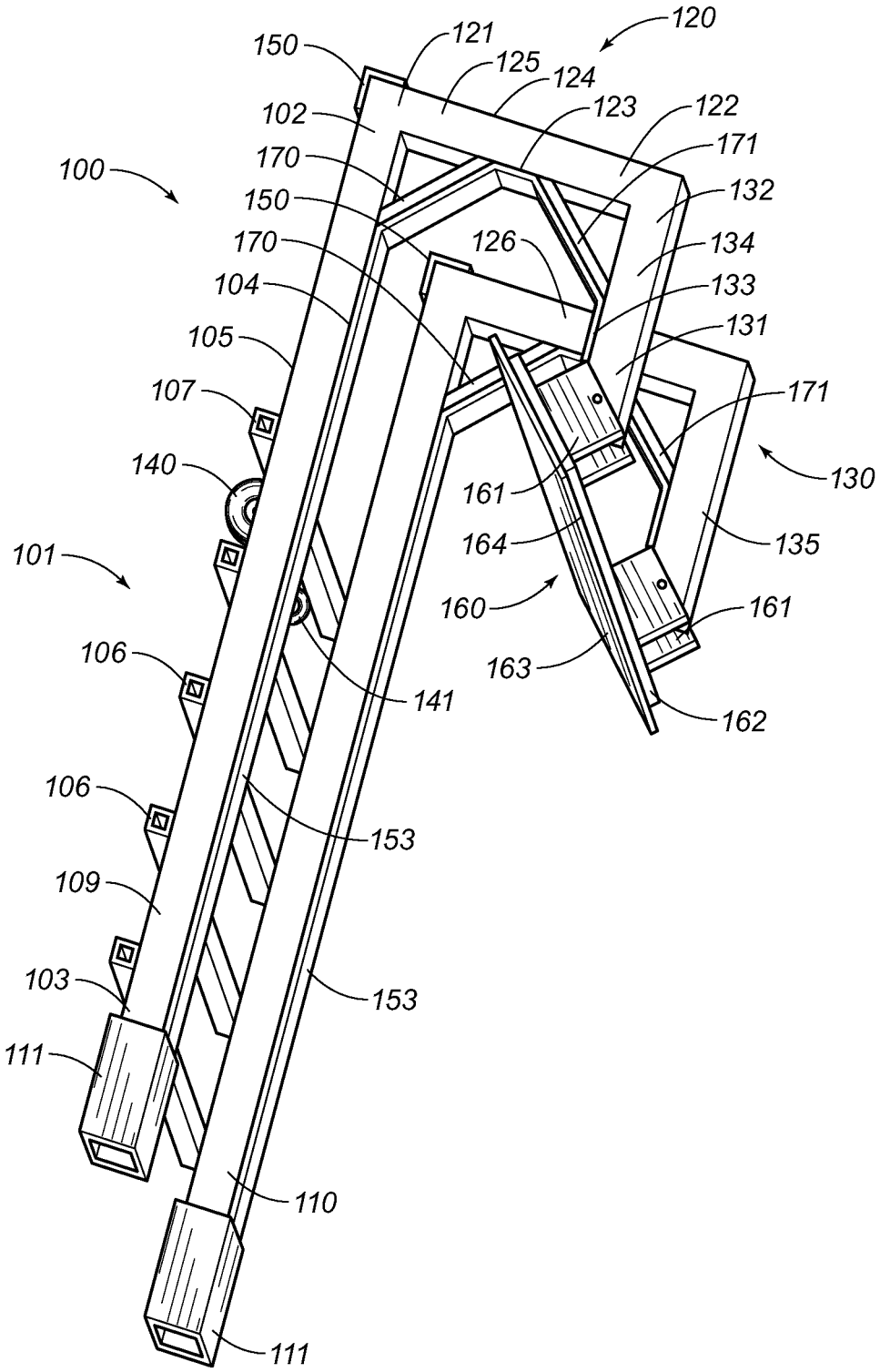
FIG. 1 shows a perspective view of an embodiment of the disclosed ladder.

The description that follows includes exemplary apparatus, system, and methods that embody the inventive subject matter. While the apparatus, system, and methods are susceptible to various modifications and alternative forms, specific embodiments thereof are shown by way of example in the drawings and will herein be described in detail. All embodiments are preferred.

It should be appreciated that the disclosed apparatus, system, and methods can be utilized by any person on a steep-pitched roof. Persons that can utilize the disclosed apparatus and method can include, but are not limited to, satellite-dish installers, home-owners, roofers, chimney workers, telecommunications personnel, and electricians.

Ladder

Referring to FIG. 1, there is shown a perspective view of an embodiment of the disclosed ladder 100. The ladder 100 is used on a steep-pitched roof, and the embodiment of the ladder 100 shown in FIG. 1 has a first section 101 having rungs 106, a second section 120 connected to the first section 101, a third section 130 connected to the second section 120, and a paw 160 pivotally connected to the third section 130. The third section 130 has a length less than or equal to a length of the second section 120, and the third section 130 also has a length less than a distance between a first rung 107 of the rungs 106 and an end 102 of the first section 101. Each of the rungs 106 has ends 108 attached to an outer surface 105 of the first section 101.

The first section 101 has an inner surface 104, the second section 120 has an inner surface 123, and the third section 130 has an inner surface 133. The first section 101 has a first rail 109 and a second rail 110 extending parallel to the first rail 109, the second section 120 has a first rail 125 and a second rail 126 extending parallel to the first rail 125, and the third section 130 has a first rail 134 and a second rail 135 extending parallel to the first rail 134.

A castor 140 can be positioned on the first section 101, and the distance between the first rung 107 of the rungs 106 and the end 102 of the first section 101 is less than or equal to a distance between the castor 140 and the end 102 of the first section 101. In FIG. 1, the castor 140 is positioned on first rung 107. An anchor member 141 can be positioned on the first section 101. In FIG. 1, the anchor member 141 is attached to the first rung 107.

A pad 153 extends along the inner surfaces 102, 123, 133 of the first, second, and third sections 101, 120, 130, respectively. A pair of bumpers 150 can be attached to the outer surface 105 of the first section 101 and to an outer surface 124 of the second section 120. The bumpers 150 can be attached to the end 102 of the first section 101 and to an end 121 of the second section 120.

The paw 160 of the ladder 100 has an ankle member 161 pivotally attached to the third section 130, a foot member 162 attached to the ankle member 161, and a sole member 163 attached to an underside 164 of the foot member 162. The sole member 163 has a width greater than a width of the foot member 162. The ankle member 161 is pivotally attached to the end 131 of the third section 130. In FIG. 1, the ankle member 161 is a pair of ankle members where one of the pair is pivotally attached to the first rail 134 of the third section 130, and another of the pair is pivotally attached to the second rail 135 of the third section 130. In FIG. 1, the first rail 134 of third section 130 is sandwiched between two plates of one of the pair of ankle members, and the second rail 135 of third section 130 is sandwiched between two plates of another of the pair of ankle members. The ankle member 160 can be pivotally attached to the third section 130 with a nut-and-bolt assembly 165.

A first pair of support members 170 extends between the first section 101 and the second section 120. One of the first pair of support members 170 extends between the first rail 109 of the first section 101 and the first rail 125 of second section 120. Another of the first pair of support members 170 extends between the second rail 110 of the first section 101 and the second rail 126 of the second section 120. A second pair of support members 171 extends between the third section 130 and the second section 120. One of the second pair of support members 171 extends between the first rail 134 of the third section 130 and the first rail 125 of second section 120. Another of the second pair of support members 171 extends between the second rail 135 of the third section 130 and the second rail 126 of the second section 120.

The first section 101, second section 120, third section 130, and rungs 106 can be made of one-inch outer-diameter tubular aluminum. The first section 101 can have a length of approximately 6'6". The second section 120 can have length of approximately 18". The third section 130 should have a length less than or equal to approximately 18" because the ladder 100 can sit too high over a ridge of a roof when the third section 130 is greater than 18". The second section 120 should extend perpendicular to the first section 101, and the end 102 of the first section 101 should connect to the end 121 of the second section 120. The third section 130 should extend perpendicular to the second section 120, and the opposite end 122 of the second section 120 should connect to the opposite end 132 of the third section 130. The third section 130 thus should be parallel to the first section 101. The distance between rails 109 and 110, 125 and 126, 134 and 135 should be less than the width of a traditional ladder, and said distance can be approximately 12" so that the ladder 100 can easily be carried up a traditional ladder to the steep-pitched roof.

The first, second, and third sections 101, 120, and 130 of the ladder 100 can be integrally formed for easy transport and use. Thus, no time is wasted adapting the ladder 100 for use with another ladder, assembling the ladder 100, or disassembling the ladder 100.

Figure 2:
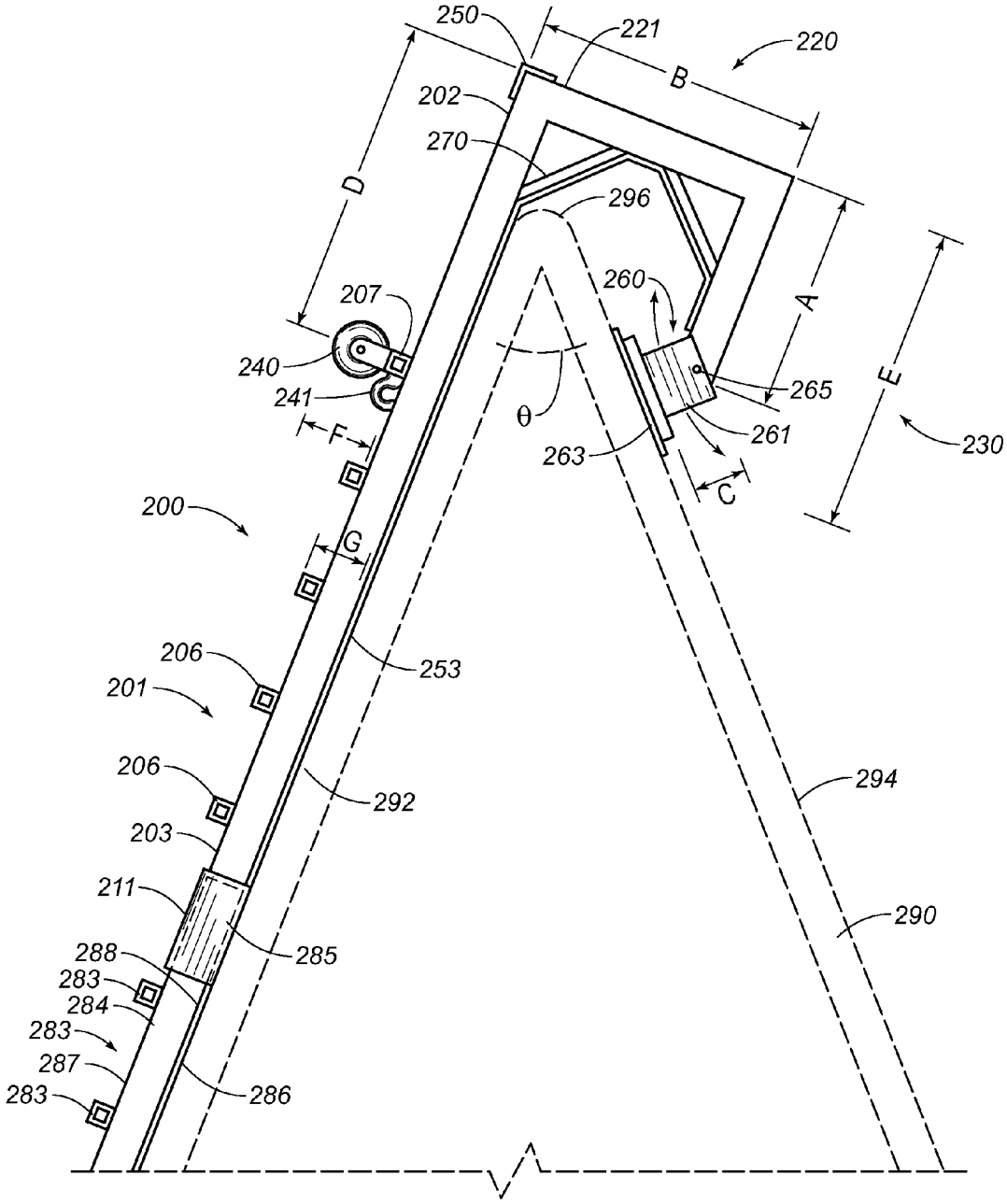
FIG. 2 shows a side elevational view of an embodiment of the ladder on a steep-pitched roof.

Referring to FIG. 2, there is shown a side elevational view of an embodiment of the ladder 200 used on a steep-pitched roof 290. The ridge 296, first surface 292, and second surface 294 of the steep-pitched roof 290 are shown with dashed lines in FIG. 2. The pad 253 on the first section 201 contacts the first surface 292 of the roof 290, and the sole member 263 of the paw 260 contacts the second surface 294 of the roof 290. A roof worker can climb the rungs 206 and stand on the rungs 206 for support. Because first surface 292 of roof 290 is longer than the first section 201 of the ladder 200, an extension 280 is coupled to the first section 201. The extension 280 has male connectors 285 on end 284 that fit inside female connectors 211 of the first section 201. The male connectors 285 are shown with dashed lines. The extension 280 also has rungs 283 attached to the outer surface 287 of the extension 280. The extension 280 is constructed of metal tubing similar to the metal tubing of the first section 201 of the ladder 200. A pad 286 is attached to the inner surface 288 of the extension 280 in a manner similar to the pad 253 of the first section 201. The pad 253 is identical in material to the material of the pad 286. The pads 253, 286 and the sole member 263 of the paw 260 can have a thickness of ⅜". The rubber material of the pads 253 and 286 should have anti-skid capabilities when positioned on roofing materials such as asphalt shingles. The sole member 263 of the paw 260 can be interchangeable and removably connected to the foot member 262 for easy replacement after wear or to change the material of the sole member 263 for different temperatures and roof materials.

The sole member 263 and pads 253 and 286 can be formed of a compressible and form-fitting polymer with a high wear-resistance, such as a rubber. The material of the sole member 263 and pads 253 and 286 can have a melting point higher than the hottest temperatures a roof can reach when exposed to the sun. For example, some roofs are known to reach 130.degrees. F in the sun; thus, the material of the sole member 263 and pads 253 and 286 should have a melting point higher than 130.degrees. F. Also, material of the sole member 263 and pads 253 and 286 can have a low stiffness at low temperatures when roof shingles can be brittle. The stiffness at low temperatures should be less than a stiffness of metal at low temperatures.

In FIG. 2, the rungs 206 can be seen attached to the outer surface 205 of the first section 201. Thus, the rungs 206 are not positioned between the rails of the first section 201 and are positioned on the outer surface 205 of the rails of the first section 201. The rungs 206 are placed on the outer surface 205 so as to increase the distance between the rungs 206 and the surface 292 of the roof 290 when the ladder 200 lies against surface 292. When rungs 206 are attached to the outer surface 205 of the first section 201, the rungs 206 of ladder 200 create a depth shown by distance G in FIG. 2. This depth creates a step on which roof workers can support themselves while on the rungs 206. Because the rails of the first section 201 and the rungs 206 can be made of one-inch outer-diameter metal tubing, the distance G is approximately 2", and this distance G is significant. First, it has been found that locating the rungs 206 between the rails of the first section 201 creates a step of one inch, which is inadequate for supporting roof workers with large feet. A two-inch step created by positioning the rungs 206 on the outer surface 205 more adequately supports roof workers with feet of all sizes without significantly increasing the weight of the ladder 200 with larger rungs. Second, when the rungs 206 are positioned on the outer surface 205 of the first section 201, a gap is created between the rungs 206 and the first surface 292 of the roof 290 when the ladder 200 is positioned on the surface 292 of the roof 290. This gap allows a roof worker to temporarily wedge a portion of his/her foot in the gap for more support and stability while on the ladder 200. Thus, placement of rungs 206 on the outer surface 205 of the first section 201 creates a significant depth in which a roof worker can use to support themselves while on the ladder 200. The gap between the rungs 206 and the first surface 292 of the roof 290 that results when rungs 206 are attached to the outer surface 205 of the first section 201 also leaves room between the rungs 206 and the first surface 292 for the fingers of a roof worker when using the rungs 206 to climb up the steep-pitched roof 290 on ladder 200 or using rungs 206 for support while performing a task on the ladder 200. The rungs 283 of the extension 280 have a similar configuration and significance for roof workers.

The castor 240 is positioned on the first rung 207. In use of the ladder 200, the castor 240 is used to roll the ladder 200 up the first surface 292 of the roof 290 before flipping and placing the ladder 200 over the ridge 296 of the roof 290 (this method is described in more detail hereinbelow). Placing the castor 240 on one of the rungs 206 creates a need for only one castor 240 because castor 240 can evenly balance ladder 200 when placed in the center of one of the rungs 206. The castor 240 should be an inline castor with no swivel. Placing the castor 240 on rung 207 is significant. First, the castor 240 creates a height F above the first surface 292 of the roof 290 when the ladder 200 is rolled up surface 292 for placement of the ladder 200 over ridge 296. The larger the height F, the more clearance the end 202 of first section 201 has when rolling the ladder 200 up the surface 292 of the steep-pitched roof 290. Second, the castor 240 gives the roof worker a visual indication if the paw 260 has cleared the ridge 296 of the roof 290 so that paw 260 does not damage or compromise the integrity of the roof 290 when the ladder 290 is flipped in order to position the ladder 200 over the ridge 296.

Bumper 250 is placed on the ladder 200 to protect the ends 202 and 221 of the first and second section 201 and 220, respectively, when using the castor 240 to roll the ladder 200 up the surface 292.

The angle Θ between the first and second surfaces 292 and 294 is an acute angle. At angle Θ, the pad 253 on the first section 201 of the ladder 200 rests on the first surface 292 of the roof 290, and the ridge 296 of the roof 290 is placed where the first section 201 and the first pair of support members 270 meet. For angles smaller than Θ, the ridge 296 of the roof 290 is placed along the first pair of support members 270 closer to the second section 220 and the paw 260 pivots upwardly more toward the second section 220 and the third section 230 of the ladder 200 so that the sole member 263 of the paw 260 remains in full contact with the second surface 294 of the roof 290. For angles larger than Θ, the ridge 296 of the roof 290 is placed along the first section 201 at increasing distances away from the first pair of support members 270 as Θ increases and the paw 260 pivots downwardly away from the second section 220 and the third section 230, and then with further increasing angles Θ, outwardly away from the first section 201 and upwardly toward the third section 230.

The distance between the end 202 of the first section 201 of ladder 200 and the first rung 207 of rungs 206 is shown by distance D in FIG. 2. Because the castor 240 is positioned on the first rung 207 in FIG. 2, the distance between the end 202 of the first section 201 of ladder 200 and the castor 240 is shown by distance D as well. Distance B is the length of the second section 220. Distance A is the length of the third section 230, and distance A should be less than or equal to approximately 18" because the third section 230 sits too high over ridge 296 of roof 290 if distance A is greater than approximately 18". Distance C is the height of the paw 260 of the ladder 200. Distance E is the combined length of the third section 230 and the paw 260.

As can be seen in FIG. 2, distance A is approximately equal to distance B. It should be appreciated that distance A should be less than or equal to distance B. Trial and error has shown that making distance A less than or equal to distance B creates stability in the ladder 200 and keeps the first section 201 from extending far above the ridge 296 for large angles Θ between the first and second surfaces 292 and 294 of the roof 290.

In FIG. 2, distance E is less than distance D, and this configuration is significant. First, when distance D is the distance between the end 202 of the first section 201 and the first rung 207 of rungs 206, and E is less than D, the rungs 206 can be vertically below the paw 260 when the ladder 200 is on steep-pitched roofs 290 that have acute angles of Θ between the surfaces 292 and 294. Thus, a roof worker cannot advance above the first rung 207, which maintains stability of the ladder 200 on the roof 290 while the ladder 200 supports the roof worker. Shortening distance E in this scenario would allow a roof worker to access the first section 201 of the ladder 200 near the end 202 of the first section 201, which would shift weight over the ridge 296 and lift paw 260 away from the second surface 294, which would thus create instability and a loss of frictional contact of the sole 263 of the paw 260 with the surface 294. Second, when distance D is the distance between the castor 240 and the end 202 of the first section 201, and E is less than D, positioning the castor 240 adjacent the ridge 296 on the first surface 292 can visually indicate that the paw 260 clears the ridge 296 of the roof 290 when the ladder 200 is flipped into position over the ridge 296. The visual indication reduces the risk of damaging the roof 290 with the paw 260 when the ladder 200 is flipped into position over the ridge 296. The visual indication also prevents the roof worker from having to traverse the surface 292 of the roof in order to determine whether the paw 260 clears the ridge 296. Because a roof worker is not tied-off to anchor member 241 (or any other anchor member) until the ladder 200 is positioned over ridge 296 of roof 290, the visual indication prevents injury to the roof worker while positioning the ladder 200 because the roof worker does not have to traverse the roof 290 while positioning a ladder 200 with this configuration.

Figure 3:
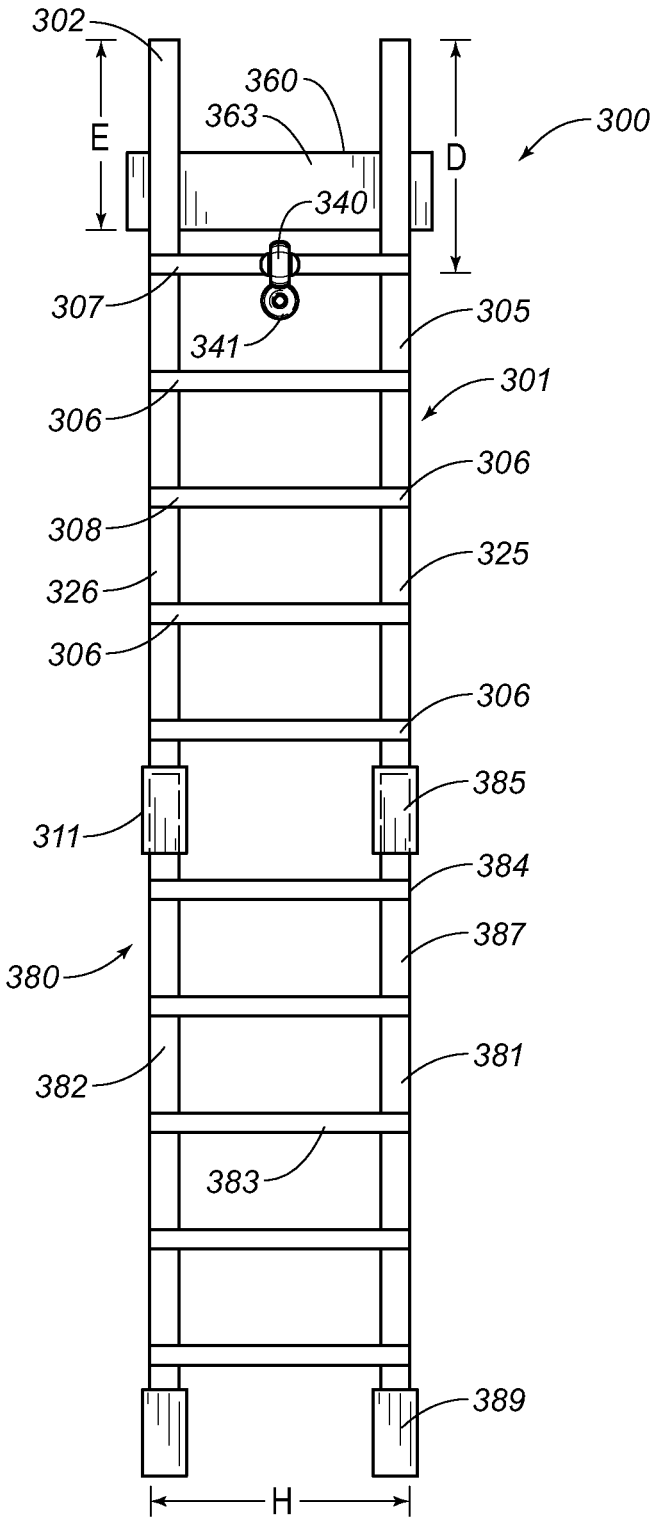
FIG. 3 shows a plan view of an embodiment of the ladder, with an extension.

Referring to FIG. 3, there is shown a plan view of the disclosed ladder 300, with an extension 380. The first section 301 has a first rail 309 and a second rail 310 parallel to the first rail 309. The extension 380 has a first rail 381 and a second rail 382 parallel to the first rail 381 and first rail 309. The male connectors 385 of the extension 380 are shown with dashed lines. The male connectors 385 are shown inserted inside the female connectors 311 of the first section 301. The rungs 383 of the extension 380 are positioned on the outer surface 387 of the extension 380 in the same manner in which rungs 306 of the first section 301 are positioned on the outer surface 305 of the first section 305. The rungs 306 and 383 have ends 308 attached to the rails 325/326 and 381/382 of the first section 301 and extension 380, respectively. The extension 380 has female connectors 389 in which the male connectors of another extension can be inserted. Thus, the ladder 300 can be used with any number of extensions 380 for any size of roof. The extensions 380 can be three feet or five feet in length so as to accommodate for the various sizes of roofs. The male and female connectors of the ladder 300 and extension 380 can be used to create a ladder of any length needed for any steep-pitched roof.

The castor 340 can be seen as in the center of rung 307. The anchor member 341 can be seen attached to the center of the rung 307 below the castor 340. Distance E is the distance between the end 302 of the first section 301 and end of the paw 360 and is also the combined length of the third section (not shown) and the paw 360. Distance D is the distance between the end 302 of the first section 301 and the first rung 307. Distance D is also the distance between the end 302 of the first section 301 and the castor 340. Distance D is also the distance between the end 302 of the first section 301 and the anchor member 341. It should be appreciated the anchor member 241 can be positioned elsewhere on the first section 301. Distance E can be less than or equal to distance D. The width H of the ladder 300 and extension 380 can be approximately 12". In use, at least a portion of the sole member 363 of the paw 360 faces the first section 301 of the ladder 300.

System

Figure 4:
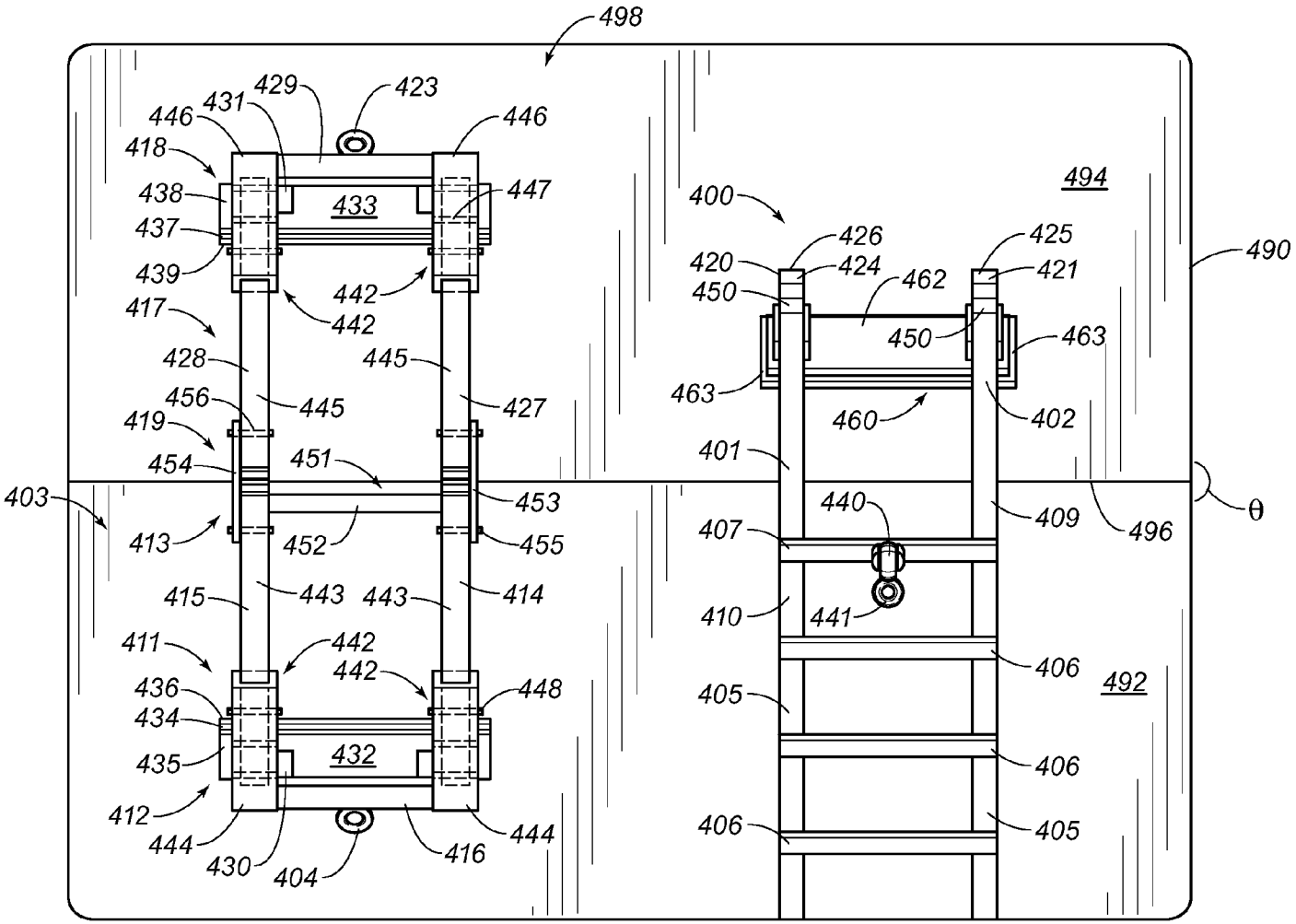
FIG. 4 shows a plan view of an embodiment of the disclosed system utilizing the ladder of FIGS. 1 through 3 and a roof-anchor apparatus.

Referring to FIG. 4, there is shown a plan view of an embodiment of the disclosed system 498. The ladder 400 can be used in the system 498 with a roof-anchor apparatus 403 on a steep-pitched roof 490, where the steep-pitched roof has a ridge 496 and a first surface 492 extending from the ridge 496 and a second surface 494 extending from the ridge 496.

The roof-anchor apparatus 403 is positioned over the ridge 496 of the steep-pitched roof 490 and has a first portion 411 angularly connected to a second portion 417, a first shoe 432 interconnected to the first portion 411 and positioned on the first surface 492 of the steep-pitched roof 490, and a second shoe 433 interconnected to the second portion 417 and positioned on the second surface 496 of the steep-pitched roof 490. The first portion 411 of the roof-anchor apparatus 403 is positioned at an angle relative to the second portion 417 of the roof-anchor apparatus 403, and the first shoe 432 and the second shoe 433 are at least partially formed of a rubber material. The angle between the first and second portions 411 and 417 of the roof-anchor apparatus 403 is approximately equal to the angle Θ between the first surface 492 and the second surface 494 of the steep-pitched roof 490.

The ladder 400 is also positioned over the ridge 496 of the steep-pitched roof 490. The paw 460 of the ladder 400 contacts the second surface 494 of the roof 490, and the inner surface (not visible) of the first section 401 contacts the first surface 492 of the roof 490. The ladder 400 is positioned next to the roof-anchor apparatus 403, and the paw 460 of the ladder contacts the same roof surface 494 as the second shoe 433 of the apparatus 403 while the first portion 401 of the ladder 400 contacts the same roof surface 492 as the first shoe 432 of the apparatus 403. A roof worker can tie-off initially to the anchor member 441 of the ladder 400 in order to position the apparatus 403 over the ridge 496 of the roof 490. The roof worker can then tie-off to the anchor member 404 of the apparatus if the worker is working on the first surface 492 of the roof 490, or the roof worker can then tie-off to the anchor member 423 of the apparatus 403 if the worker is working on the second surface 494 of the roof 490.

The bumpers 450 can be seen on the end 402 of the outer surface 405 of the first section 401 and on the end 421 of the outer surface 424 of the second section 420. The castor 440 is positioned in the center of the first rung 407 of the rungs 406. The sole member 463 of paw 460 is wider than the foot member 462 of the paw 460. Bumpers 450 can be seen on both the first and second rails 409 and 410 of the first section 401 and the first and second rails 425 and 426 of the second section 420. The rungs 406 are attached to the outer surface 405 of the first section 401.

Now discussing the roof-anchor apparatus 403 in more detail, the first portion 411 of the roof-anchor apparatus 403 has an end 412 and an opposite end 413. The first shoe 432 is interconnected to the end 412 of the first portion 411. The second portion 417 of the roof-anchor apparatus 403 has an end 418 and an opposite end 419. The second shoe 433 is interconnected to the end 418 of the second portion 417. The opposite end 419 of the second portion 417 is positioned adjacent the opposite end 413 of the first portion 411. The roof-anchor apparatus 403 also has a first leg support 430 connected to the end 412 of the first portion 411 and to the first shoe 432, and a second leg support 431 connected to the end 418 of the second portion 417 and to the second shoe 433. In FIG. 4, the first shoe 432 is interconnected to the first portion 411 by first leg support 430 and the second shoe 433 is interconnected to the second portion 417 by second leg support 431; however, it should be appreciated that the first shoe 432 can be directly connected to the first portion 411 and the second shoe 433 can be directly connected to the second portion 417.

In FIG. 4, the first portion 411 is pivotally connected to the second portion 417 with hinges. The hinges allow the first portion 411 of the roof-anchor apparatus 403 to be positioned at many angles relative to the second portion 417 of the roof-anchor apparatus 403. Alternatively, it should be appreciated that the first portion 411 can be connected to the second portion 417 by a weld or other like means of connecting the portions 411 and 417. In this alternative scenario, the roof-anchor apparatus 403 would be useful for only one angle, and another roof-anchor apparatus 403 having a different angle between the first portion 411 and the second portion 417 would be needed for a steep-pitched roof having a different angle.

An anchor member 404 can be connected to the first portion 411, and an anchor member 423 is connected to the second portion 417. The anchor members 404 and 423 allow a roof worker of satellite dishes to "tie-off" to the roof-anchor apparatus 403. Placing anchor member 404 on the first portion 411 and anchor member 423 on the second portion 417 allow a roof worker to tie-off to the roof-anchor apparatus 403 on either of the two surfaces extending from the ridge of a roof without changing the position of the roof-anchor apparatus 403. In FIG. 4, the anchor members 404 and 423 are eye-shaped pieces. To tie-off, a roof worker can connect a rope, chain, wire, cord, cable or the like to himself/herself and to one of the anchor members 404 and 423 that is closest to the roof worker. If the roof worker falls or slips on a steep-pitched roof, the rope, chain, wire, cord, cable, or the like pulls tight against the anchor member 404 or 423 because the roof-anchor apparatus 403 holds firmly against the surfaces of the roof and anchors the roof worker to the roof.

A locking member 451 locks the first portion 411 at the angle relative to the second portion 417. The locking member 451 has a first side plate 453, a second side plate 454, and a cross bar 452. The cross bar 452 is connected to the first side plate 453 and to the second side plate 454. The first side plate 453 and the second side plate 454 are connected to the opposite end 413 of the first portion 411. The first side plate 453 and the second side plate 454 are also connected to the opposite end 419 of the second portion 417. Pins 455 connect the first plate 453 and the second plate 454 to the opposite end 419 of the second portion 417 of the roof-anchor apparatus 403. The first plate 453 and the second plate 454 of the locking member 451 each have holes 456 formed therein, and the pins 455 are inserted into the appropriate holes 456 so that the first portion 411 of the roof-anchor apparatus 403 extends at an angle relative to the second portion 417. The first and second side plates 453 and 454 can be connected to the first portion 411 with a permanent pivoting connection, a releasably attached pivoting connection, a releasably attached connection, and the like. In FIG. 4, the first plate 453 and the second plate 454 are connected to the opposite end 413 of the first portion 411 with pins 455; thus, the connection shown in FIG. 4 is a releasably attached connection.

The first shoe 432 has an upper pad layer 435, a foot 434 positioned under the upper pad layer 435, and a lower pad layer 436 positioned under the foot 434. The upper pad layer 435 and the lower pad layer 436 can be integrally wrapped around the foot 434. The second shoe 433 can be similar to the first shoe 432. The second shoe 433 has an upper pad layer 438, a foot 437 positioned under the upper pad layer 438, and a lower pad layer 439 positioned under the foot 437. The foot 434 of the first shoe 432 is connected to the first leg support 430 so that the first leg support 430 is positioned between the first shoe 432 and the first portion 411. Likewise, the foot 437 of the second shoe 433 is connected to the second leg support 431 so that the second leg support 431 is positioned between the second shoe 433 and the second portion 417. The first leg support 430 can extend perpendicular to the first portion 411, and the second leg support 431 can extend perpendicular to the second portion 417. The upper pad layer 438 and the lower pad layer 439 can be integrally wrapped around the foot 437.

The upper pad layers 435 and 438 and lower pad layers 436 and 439 can be formed of a compressible and form-fitting polymer with a high wear-resistance, such as a rubber. The material of the lower pad layers 436 and 439 can have a melting point higher than the hottest temperatures a roof can reach when exposed to the sun. For example, some roofs are known to reach 130.degrees. F in the sun; thus, the material of the lower pad layers 436 and 439 should have a melting point higher than 130.degrees. F. Also, material of the lower pad layers 436 and 439 can have a low stiffness at low temperatures when roof shingles can be brittle. The stiffness at low temperatures should be less than a stiffness of metal at low temperatures.

The first portion 411 has a first member 414 and a second member 415 extending in spaced parallel relationship with the first member 414. A third member 416 extends between the first member 414 and the second member 415 at end 412 of the first portion 411, and the third member 416 is connected to the first member 414 and to the second member 415. The third member 416 of the first portion 411 interconnects or connects to the first shoe 432. The configuration of the first member 414, second member 415, and third member 416 forms a rectangular shape, and it should be appreciated the members 414, 415, and 416 of the first portion 411 can also form other shapes such as a triangle or trapezoid. In FIG. 4, the members 414, 415, and 416 are formed of a tubular metal, and the connections between the members 414, 415, and 416 are welded.

The second portion 417 has a first member 427 and a second member 428 extending in spaced parallel relationship with the first member 427. A third member 429 extends between the first member 427 and the second member 428 at end 418 of the second portion 417, and the third member 429 is connected to the first member 427 and to the second member 428. The third member 429 of the second portion 417 interconnects or connects to the second shoe 433. The configuration of the first member 427, second member 428, and third member 429 form a rectangular shape, and it should be appreciated the members 427, 428, and 429 of the second portion 417 can also form other shapes such as a triangle or trapezoid. In FIG. 4, the members 427, 428, and 429 are formed of a tubular metal, and the connections between the members 427, 428, and 429 are welded.

In FIG. 4, the first leg support 430 is a pair of legs connected to the ends of the third member 416. The pair of legs of the first leg support 430 extends through the upper pad layer 435 of the first shoe 432 and connects to the foot 434 of the first shoe 432. The second leg support 431 is a pair of legs connected to the ends of the third member 429. The pair of legs of the first leg support 430 extends through the upper pad layer 438 of the second shoe 433 and connects to the foot 437 of the second shoe 433.

It should be appreciated that the first and second members 414 and 415 of the first portion 411 can alternatively be interconnected or connected to the first shoe 432 instead of the third member 416. Likewise, it should be appreciated that the first and second members 427 and 428 of the second portion 417 be interconnected or connected to the second shoe 433 instead of the third member 429. Shoes 432 and 433 can interconnect or connect to the ends 412 and 418 of the portions 411 and 417, respectively, because experiments have shown the first shoe 432 and second shoe 433 have a more even and uniform contact with surfaces 492 and 494 of the steep-pitched roof 490. A more even and uniform contact with roof surfaces 492 and 494 is desirable because a larger surface area of contact is made between the shoes 432, 433 and the roof 490. A larger surface area of contact provides more frictional contact, which provides more stability and less movement of the roof-anchor apparatus 403. Thus, the roof-anchor apparatus 403 sits firmly over the ridge 496 of the roof 490.

It should be appreciated the first and second members 414, 415 can be connected with the third member 416 where the first and second members 414, 415 extend for the entire length of the first portion 411 and where the third member 416 extends between the first and second members 414, 415. Alternatively, the third member 416 can extend for the entire width of the first portion 411 where the first and second members 414, 415 do not extend past the ends of the third member 416. Likewise, it should be appreciated the first and second members 427, 428 can be connected with the third member 429 where the first and second members 427, 428 extend for the entire length of the second portion 417 and where the third member 429 extends between the first and second members 427, 428. Alternatively, the third member 429 can extend for the entire width of the first portion 417 where the first and second members 427, 428 do not extend past the third member 429.

FIG. 4 shows the use of square metal tubing for first and second portions 411 and 417, the first and second leg supports 430 and 431, and the cross bar 452 of the locking member 451. The metal tubing can be approximately 1½" square-steel tubing. The pins 455 can be approximately ⅜" in diameter. The foot 434 and foot 437 can have a length of approximately 21½" and a width of approximately 4". The leg supports 430 and 431 can be made of ½" square steel tubing and can have a length of approximately 3". The anchor members 404 and 423 can be a ½" eye hook. The first and second members 414 and 415 of the first portion 411 and the first and second members 427 and 428 of the second portion 417 can have a length of approximately 24". The third member 416 of the first portion 411 and the third member 429 of the second portion 417 can have a length of approximately 19". The first and second side plates 453 and 454 of the locking member 451 can have a length of approximately 11", a width of approximately 4", and a thickness of approximately 3/16".

The upper pad layers 435 and 438 and lower pad layers 436 and 439 can be formed of a compressible and form-fitting polymer with a high wear-resistance, such as a rubber. The material of the lower pad layers 436 and 439 can have a melting point higher than the hottest temperatures a roof can reach when exposed to the sun. For example, some roofs are known to reach 130.degrees. F in the sun; thus, the material of the lower pad layers 436 and 439 should have a melting point higher than 130.degrees. F. Also, material of the lower pad layers 436 and 439 can have a low stiffness at low temperatures when roof shingles can be brittle. The stiffness at low temperatures should be less than a stiffness of metal at low temperatures.

The roof-anchor apparatus 403 is extremely stable while using only a few efficient points of contact (shoes 432 and 433) with the surfaces 492 and 494 extending from the ridge 496 of the roof 490. The shoes 432 and 433 frictionally contact roof surfaces 492 and 494, and the material of the shoes 432 and 433 holds against the roof surfaces 492 and 494 even at low and high temperatures without damaging or compromising the integrity of the roof surfaces 492 and 494. Thus, the roof-anchor apparatus 403 simultaneously provides a stable anchor for roof workers of satellite dishes and other roof workers while contacting the roof 490 with shoes 432 and 433 configured to hold against roof surfaces 492 and 494 without damaging or compromising the integrity of the roof surfaces 492 and 494.

The roof-anchor apparatus 403 can have a telescoping mechanism 442 positioned on the first portion 411 and the second portion 417. The telescoping mechanism 442 of the first portion 411 telescopes a first side 443 of the first portion 411 relative to a second side 444 of the first portion 411. The first side 443 is inserted within the second side 444 in order to telescope the first portion 411. Pins 448 are inserted through holes in the first and second sides 443 and 444 to hold the first portion 411 at a desired length. The telescoping mechanism 442 of the second portion 417 telescopes a first side 445 of the second portion 417 relative to a second side 446 of the second portion 417. The first side 445 is inserted within the second side 446 in order to telescope the second portion 417. Pins 448 are inserted through holes in the first and second sides 445 and 446 to hold the second portion 417 at a desired length. The telescoping mechanism 442 should hold the first portion 411 and the second portion 417 at the same lengths to ensure the downward pressures exerted by the roof-anchor apparatus 403 on the first and second shoes 432 and 433 maintain uniformity and consistency of contact with the first and second surfaces 492 and 494 of the steep-pitched roof 490.

Method

Reference numerals from FIG. 4 are used for clarity of discussion of the method hereinbelow. A method uses an embodiment of the ladder 400 and an embodiment of the roof-anchor apparatus 403 of FIG. 4 to traverse a steep-pitched roof 490. An embodiment of the method includes rolling the castor 440 of the first section 401 of the ladder 400 up the first surface 494 of the steep-pitched roof 490 so that the outer surface 405 of the ladder 400 faces the first surface 494 of the steep-pitched roof 490 during the step of rolling.

The castor 440 of the ladder 400 is then positioned adjacent the ridge 496 and on the first surface 494 so that a plane of the paw 460 of the ladder 400 clears the ridge 496 and so that the paw 460 of the ladder 400 is positioned above the first surface 494 of the roof 490 while the ladder 400 is rolled and positioned, i.e. during the steps of rolling and positioning.

The ladder 400 is then flipped so that the paw 460 of the ladder 400 is positioned above the second surface 494 of the roof 490 and so that the inner surface (104 in FIG. 1) of the first section 401 of the ladder 400 faces the first surface 492 of the roof 490 after the step of flipping. The pad (153 in FIG. 1) can be attached to the inner surface of the ladder 400, and the pad can also face the first surface 492 after the step of flipping.

The ladder 400 then slides downwardly along the first surface 492 of the roof 490 until the paw 460 of the ladder 400 engages the second surface 494 of the roof 490. When the ladder 400 is in position over the ridge 496 of the roof 490, the pad of the ladder 400 is positioned between the first surface 492 of the roof 490 and the inner surface of the ladder 400. The sole member 463 of the paw 460 contacts the second surface 494 of the roof 490.

If the roof 490 is longer than the ladder 400, extensions (380 in FIG. 3) can be added to lengthen the ladder 400 to a length appropriate for the roof 490.

The first portion 411 of the roof-anchor apparatus 403 can be set at an angle relative to the second portion 417 of the roof-anchor apparatus. The angle between the first and second portions 411 and 417 of the roof-anchor apparatus is approximately Θ, the angle between first surface 492 and second surface 494 of the roof 490 in FIG. 4. In the method, after the ladder 400 is positioned on the roof 490, the first shoe 432 of the roof-anchor apparatus 403 is placed on the first surface 492 of the roof 490, and the second shoe 433 of the roof-anchor apparatus 403 is placed on the second surface 494 of the roof 490 so that the roof-anchor apparatus 403 is positioned over the ridge 496 of the roof 490.

A roof worker using the ladder 400 and roof-anchor apparatus 403 can tie-off to an anchor member 441 connected to the first section 401 of the ladder 400. A person using the ladder 400 and roof-anchor apparatus 403 can then tie-off to an anchor member 404 connected to the first portion 411 or second portion 417 of the roof-anchor apparatus 403. In some embodiments of the method, a roof worker can tie-off to the anchor member 441 before positioning the roof-anchor apparatus 403 over the ridge 496 of the roof 490, and then the roof worker can tie-off to one of the anchor members 404 and 423 after the roof-anchor apparatus 403 is positioned over the ridge 496.

Thus, after placing the ladder 400 and roof-anchor apparatus 403 on roof 490, the second surface 494 of roof 490 has only two points of contact by the system 498: the paw 460 of the ladder 200, and the second shoe 433 of the roof-anchor apparatus 403. After placing the ladder 400 and roof-anchor apparatus 403 on roof 490, the first surface 492 of roof 490 has one point of contact: the first shoe 432 of the roof-anchor apparatus 403. After placing the ladder 400 and roof-anchor apparatus 403 on roof 490, the first surface 492 of roof 490 has a line of contact: the first section 401 of the ladder 400. The line of contact and points of contact provide superior stability and support for roof workers using the ladder 400, system 498, and methods.

It should be understood that the drawings and specification are not intended to limit the embodiments to the particular form(s) disclosed. It is intended that the disclosure shall cover all modifications, equivalents and alternatives falling within the spirit and scope of the following claims.

We claim:

1. A system for vertically and horizontally traversing a steep-pitched roof, wherein the steep-pitched roof has a ridge and a first surface extending from the ridge and a second surface extending from the ridge, the system comprising:

a roof-anchor apparatus for use over the ridge of the steep-pitched roof comprising:

a first portion having an end and an opposite end, wherein the first portion consists of:

a first member having an end and an opposite end;

a second member having an end and an opposite end; and a third member extending between the end of the first member of the first portion and the end of the second member of the first portion;

a first shoe interconnected to the end of the first portion via the third member of the first portion, wherein the first shoe is configured to hold the apparatus against the steep-pitched roof via frictional contact;

a second portion having an end and an opposite end, the opposite end of the second portion positioned adjacent the opposite end of the first portion, the first portion being positioned at an angle relative to the second portion so as to approximate the angle of the ridge of the steep pitched roof, wherein the second portion consists of:

a first member having an end and an opposite end;

a second member having an end and an opposite end; and a third member extending between the end of the first member of the second portion and the end of the second member of the second portion;

a second shoe interconnected to the end of the second portion via the third member of the second portion, wherein the second shoe is configured to hold the apparatus against the steep-pitched roof via frictional contact; and a locking member for adjustably locking the first portion at the angle relative to the second portion, wherein the locking member comprises:

a first plate connected to the first member of the portion and to the first member of the second portion;

a second plate connected to the second member of the first portion and to the second member of the second portion; and a cross bar extending between and connected to the first plate and to the second plate; and a ladder for use on the steep-pitched roof comprising:

a first section having a first end and a second end, wherein the first section comprises a first rail, a second rail extending parallel to the first rail, and a plurality or rungs, wherein each of the plurality of rungs is attached to the first rail and to the second rail;

a second section having an end and an opposite end, wherein the end of the second section is connected to the first end of the first section;

a third section having an end and an opposite end, wherein the opposite end of the third section is connected to the opposite end of the second section; and a paw comprising an ankle member pivotally connected to the end of the third section, the third section having a length less than or equal to a length of the second section, the third section and the paw having a combined length less than a distance between a first rung of the plurality of rungs and the first end of the first section, wherein the first rung is the rung of the plurality of rungs which is closest to the first end of the first section, the third section being integrally formed with the second section.

2. The system of claim 1, further comprising:

a castor positioned adjacent the first rung, the distance between the first rung of the plurality of rungs and the first end of the first section being less than or equal to a distance between the castor and the first end of the first section, the third section and the paw having a combined length less than a distance between the castor and the first end of the first section; and an anchor member positioned on the first section.

3. The system of claim 1, each of the plurality of rungs of the ladder having ends attached to an outer surface of the first section.

4. The system of claim 1, the first section having an inner surface, the second section having an inner surface, the third section having an inner surface, the ladder further comprising:

a pad extending along the inner surface of the first section.

5. The system of claim 4, the pad of the ladder extending along the inner surface of the second section, the pad of the ladder extending along the inner surface of the third section.

6. The system of claim 1, the ladder further comprising:

a bumper attached to an outer surface of the first section and to an outer surface of the second section, the bumper attached to the first end of the first section and to an end of the second section.

7. The system of claim 1, wherein the roof-anchor apparatus further comprises:

a first leg support positioned between the first shoe and the first portion, wherein the first leg support is connected to the end of the first portion and to the first shoe; and a second leg support positioned between the second shoe and the second portion, wherein the second leg support is connected to the end of the second portion and to the second shoe.

8. The system of claim 1, each of the second section and the third section of the ladder comprising:

a first rail; and a second rail extending parallel to the first rail.

9. The system of claim 8, the ladder further comprising:

a first pair of support members extending between the first section and the second section, one of the first pair of support members extending between the first rail of the first section and the first rail of the second section, another of the first pair of support members extending between the second rail of the first section and the second rail of the second section; and a second pair of support members extending between the third section and the second section, one of the second pair of support members extending between the first rail of the third section and the first rail of the second section, another of the second pair of support members extending between the second rail of the third section and the second rail of the second section.

10. The system of claim 1, wherein the first plate of the locking member is connected to the opposite end of the first portion, wherein the second plate of the locking member is connected to the opposite end of the first portion.

11. The system of claim 1, the roof-anchor apparatus further comprising:

an anchor member positioned on the first portion of the roof-anchor apparatus.

12. The system of claim 1, each of the first shoe and the second shoe of the roof-anchor apparatus comprising:

an upper pad layer;

a foot positioned under the upper pad layer; and a lower pad layer positioned under the foot, the upper pad layer and the lower pad layer being integrally wrapped around the foot.

13. The system of claim 1, the paw of the ladder comprising:

an ankle member pivotally attached to the third section;

a foot member attached to the ankle member; and a sole member attached to an underside of the foot member, the sole member having a width greater than a width of the foot member.

14. The system of claim 1, wherein the second section extends perpendicular to the first section, wherein the third section extends perpendicular to the second section.

15. The system of claim 1, wherein the length of the third section is less than or equal to about 18 inches.

* * * * *

UNITED STATES PATENT AND TRADEMARK OFFICE

CERTIFICATE OF CORRECTION

PATENT NO. : 8,857,568 B2
APPLICATION NO. : 12/954615
DATED : October 14, 2014
INVENTOR(S) : Odes Foster, Sr. et al.

It is certified that error appears in the above-identified patent and that said Letters Patent is hereby corrected as shown below:

In the Claims,

Column 14, Line 19, replace "of the portion" with --of the first portion--.

Signed and Sealed this
Twenty-fourth Day of February, 2015

Michelle K. Lee

Michelle K. Lee
*Deputy Director of the United States Patent and Trademark Office*